US007977884B2

(12) United States Patent
Jüngst et al.

(10) Patent No.: US 7,977,884 B2
(45) Date of Patent: Jul. 12, 2011

(54) HIGH-PRESSURE DISCHARGE LAMP HAVING COOLING LAMINATES FITTED AT THE END OF THE DISCHARGE VESSEL

(75) Inventors: Stefan Jüngst, Zorneding (DE); Klaus Stockwald, Germering (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 121 days.

(21) Appl. No.: 12/087,470

(22) PCT Filed: Jan. 16, 2007

(86) PCT No.: PCT/EP2007/050390

§ 371 (c)(1), (2), (4) Date: Jul. 8, 2008

(87) PCT Pub. No.: WO2007/082885

PCT Pub. Date: Jul. 26, 2007

(65) Prior Publication Data

US 2008/0315770 A1 Dec. 25, 2008

(30) Foreign Application Priority Data

Jan. 17, 2006 (DE) ..... 10 2006 002 261

(51) Int. Cl.
*H01J 7/24* (2006.01)

(52) U.S. Cl. ..... 313/623

(58) Field of Classification Search ..... 313/17, 313/34, 39, 43–46, 493, 634, 635, 318.07
See application file for complete search history.

(56) References Cited

U.S. PATENT DOCUMENTS

| | | | | |
|---|---|---|---|---|
| 4,970,431 | A * | 11/1990 | Vegter et al. | 313/634 |
| 4,983,889 | A * | 1/1991 | Roberts | 315/246 |
| 5,500,570 | A * | 3/1996 | Jeong | 313/634 |
| 5,825,129 | A * | 10/1998 | Van der Leeuw et al. | 313/634 |
| 6,084,352 | A * | 7/2000 | Seki et al. | 313/635 |
| 6,181,065 | B1 | 1/2001 | Huettinger et al. | |
| 6,566,814 | B2 | 5/2003 | Johnston et al. | |
| 6,879,101 | B2 | 4/2005 | Deguchi et al. | |
| 2002/0153837 | A1 | 10/2002 | Johnston et al. | |
| 2007/0120492 | A1 * | 5/2007 | Selezneva et al. | 313/634 |

FOREIGN PATENT DOCUMENTS

| | | | |
|---|---|---|---|
| DE | 197 27 429 | A1 | 1/1999 |
| EP | 0 315 261 | A2 | 5/1989 |
| EP | 0 506 182 | A2 | 9/1992 |
| EP | 1339090 | A1 | 8/2003 |
| GB | 2 281 148 | A | 2/1995 |
| JP | 3-4436 | A | 1/1991 |
| JP | 8-250071 | A | 9/1996 |

* cited by examiner

*Primary Examiner* — Joseph L Williams
*Assistant Examiner* — Andrew J Coughlin

(57) ABSTRACT

Laminates, which are used for cooling the discharge vessel, are fitted to the seals of the ceramic discharge vessel. They are an integral part of the seal.

13 Claims, 7 Drawing Sheets

HIGH-PRESSURE DISCHARGE LAMP HAVING COOLING LAMINATES FITTED AT THE END OF THE DISCHARGE VESSEL

TECHNICAL FIELD

The invention is based on a high-pressure discharge lamp in accordance with the preamble of claim 1. Such lamps are in particular high-pressure discharge lamps with a ceramic discharge vessel for general lighting. The lamps are in particular metal-halide lamps or else sodium high-pressure lamps or mercury high-pressure lamps.

PRIOR ART

U.S. Pat. No. 4,970,431 has disclosed a sodium high-pressure discharge lamp, in which the bulb of the discharge vessel is manufactured from ceramic. Fin-like protrusions which are used for heat dissipation are plugged on at the ends of the cylindrical discharge vessel.

EP-A 506 182 has disclosed coatings consisting of graphite or carbon or the like which are applied to ceramic discharge vessels at the ends in order to bring about a cooling effect.

DESCRIPTION OF THE INVENTION

The object of the present invention is to provide a high-pressure discharge lamp whose color scatter is markedly reduced in comparison to previous lamps.

This object is achieved by the characterizing features of claim 1.

Particularly advantageous configurations are given in the dependent claims.

The high-pressure discharge lamp with a ceramic discharge vessel has a central part and two ends, which are sealed by seals, electrodes being anchored in the seals and extending into the discharge volume enveloped by the discharge vessel, a filling, which contains metal halides or else metals, being accommodated in the discharge volume. In this case, fin-like laminates, which extend radially outwards, are positioned at the ends. In this case, the surface of the laminates is overall predominantly arranged in a region which is positioned, remote from the discharge, behind a line which is fixed by the projection of the tip of the electrode onto the inner surface of the discharge vessel.

Preferably, the arrangement of the laminates is such that they are rotationally symmetrical to one another, in particular with a three-fold to eight-fold symmetry. In this case, for reasons of simplicity, the form of the laminates can be substantially identical, but is not necessarily so. For example, two sets of laminates can be used alternately, i.e. for eight-fold symmetry in each case four laminates of one sort.

The invention is particularly suitable for metal-halide lamps which are subjected to a high level of loading and in which the ratio between the inner length and the maximum inner diameter of the discharge vessel, the so-called aspect ratio, is between 1.0 and 8.0, preferably at least 1.5. Limit values are included here.

In terms of manufacturing technology it is advantageous that the width of the laminates is of the order of magnitude of the wall thickness of the central part of the discharge vessel, to be precise in the case of a constant width, deviates from this wall thickness in particular by at most 50%, preferably at most 25%.

In particular, advantageously the seals are in the form of capillaries. However, they can also have a different design; see, for example, DE-A 197 27 429, where a cermet pin is used. The invention can also be used for stopper technologies, in which the laminates can either be positioned on the discharge vessel, or on the separate stopper part, or laminates can be positioned on both bodies.

A particularly good cooling effect can be achieved if the laminates are positioned on a part of the seals which is adjacent to the ends, or if the laminates attach at the ends.

In general, the laminates have two broad sides and one narrow side, the narrow side pointing radially outwards. These sides together define the surface of the laminate. Particularly preferably, the narrow side can be beveled and in particular can be provided with a coating. The coating should have high emissivity. Suitable materials are in particular graphite or carbon, i.e. other carbon modifications such as, for example, DLC (diamond-like carbon).

In general, the cooling response can also be controlled by part of the seal, in particular part of the laminate such as the narrow side, being covered by a coating having a high emissivity. It is also possible to use a coating on the covering without at the same time using a laminate-like projection at this point.

$Al_2O_3$, in particular PCA, or any other conventional ceramic such as AlON or AlN can be used as the material for the bulb. The choice of filling is also not subject to any particular restriction.

Discharge vessels or burners for high-pressure lamps with an approximately uniform wall thickness distribution and shapes which become thin at the ends sometimes demonstrate a high level of color scatter as a result of the high level of distribution of the metal halide filling in the interior of the discharge vessel, depending on the filling composition. Typically, the filling condenses in the region remote from the discharge behind the line which is fixed by the projection of the electrode tip onto the inner burner surface. Until now, it has not been possible to set with sufficient precision the filling positioning onto a zone of the surface in the interior of the discharge vessel, which corresponds to a narrow temperature range, and into the residual volumes of the possibly provided capillaries. It is therefore now a question of attaching fins or laminates to the discharge vessel whose effect comes to bear predominantly in a region which is positioned behind the line which is fixed by the projection of the electrode tip onto the inner burner surface. Predominantly means in particular that at least two thirds of the surface of the fins is covered in a region which is positioned, remote from the discharge, behind the line which is fixed by the projection of the electrode tip onto the wall of the discharge vessel.

Previous discharge vessels often have a form with an increased wall thickness at the end faces, for example in the case of cylindrical burner forms, and as a result produce an enlarged end surface. A further problem is the emission of IR radiation which is increased as a result of the specific emission coefficient of the ceramic, which is dependent on the wall thickness, during operation of the discharge vessel in the evacuated or gas-filled outer bulb. In this case, the surface of the discharge vessel is determined by the specific emission power in accordance with the Stefan-Boltzmann law:

$$P_{rad}/A=\epsilon*\sigma*T^4,$$

where $P_{rad}/A$=emitted radiation power per unit surface area $\epsilon$=hemispherical emission coefficient of the emitting surface, $\sigma$=Stefan-Boltzmann constant, T=surface temperature.

As a result, a concentrated filling distribution is produced as a result of a heat sink effect at the end of the discharge vessel, and this filling distribution determines the vapor pressures of the metal halides used in the discharge vessel in such a way that a color scatter value which is sufficient for ceramic lamp systems of typically=75 K for relatively large lamp groups of the same operating power can be set.

In the case of spherical discharge vessels, or those with semicircular end forms or conically tapering end forms or elliptically shaped end forms and a cylindrical central part having relatively high aspect ratios IL/ID of approximately 1.5 to 8, particularly serious problems result. Owing to the narrow transition to the region of the seal, usually a capillary region, sometimes insufficient cooling effects result at the end of the discharge vessel and therefore insufficient fixing of the temperature results, and this temperature is insufficient for concentrated filling depositing in a narrow temperature range of the inner wall.

According to the invention, essentially two mechanisms are provided for increased cooling of the end of the discharge vessel. This means the transition of the discharge vessel, in which the arc discharge burns, to the end forms, which contain the electrode structures for the electrical or electromagnetic line coupling-in. This is particularly the case if there is no notable increase in the wall thickness in the end region in comparison with the wall thickness of the discharge vessel—in the case of cylindrical discharge vessels this is typically a factor of 1.5 to 2.5—as a result of the shaping. An application for this has not been ruled out, however.

Essential is the enlargement of the surface by wing-like or fin-like shaped-out portions which are integrally formed on the seal in the transition region, preferably with a longitudinal alignment parallel to the axis with at least three-fold symmetry and at most eight-fold symmetry of the distribution around the circumference. These are in particular laminates.

The fin-like shaped-out regions can be essentially smooth faces or else be faceted on the surface. In particular, the facet regions can be two-dimensionally delimited from the rest of the surface region of the laminate and can have a defined alignment with respect to the axis and with respect to the center of gravity of the discharge vessel.

In some circumstances there is also a coating with a material, which, in the near infrared (NIR), which typically means a wavelength range of between 1 and 3 μm, has an increased hemispherical emissivity $\epsilon$ in the temperature range of between 650 and 1000° C. in comparison with the ceramic material. The coating should preferably be applied in the region of the transition between the end of the discharge vessel and the seal. In particular, this also applies to the seal on its own, in which case the coating can also be applied without the laminates.

Suitable coating materials are coatings which are resistant to high temperatures and have a hemispherical emission coefficient $\epsilon$ of preferably $\epsilon$=0.6. This includes graphite, mixtures of $Al_2O_3$ with graphite, mixtures of $Al_2O_3$ with carbides of the metals Ti, Ta, Hf, Zr, and semi-metals such as Si. Mixtures which also in addition contain other metals for setting an electrical conductivity which may be desired are also suitable.

Of course both measures can be combined in a suitable manner such that part of the surface emission increase takes place via an enlargement of the surface by means of laminates and at the same time part takes place by the coating of parts of these laminates or the adjacent cooler sealing regions.

Overall, a series of advantages result when using integral laminates in ceramic discharge vessels:

1. More effective cooling with at the same time relatively little additional ceramic compound;
2. Reduction in the longitudinal flow of heat into the seal;
3. Markedly increased flexibility of the surface setting in the end region;
4. Reduction in the shadowing effects in the solid angle range of the electrode supply line;
5. Adjustability of effective local thermostat action by means of relatively small surface regions.

These properties are particularly important for forms of discharge vessels which are subjected to high loading and have a small overall surface and possibly an increased aspect ratio, since local cooling by means of heat flow over relatively large wall cross-sectional areas becomes difficult under these conditions.

The overall mass of the discharge vessel is only increased insignificantly by this type of laminate and therefore remains below a critical value which would negatively influence the start-up response of the lamp on ignition. There is therefore an ingenious compromise between effective ignition and effective cooling. This measure allows for a very high level of color stability whilst knowingly accepting poor isothermy. This takes place as a deviation from the previous target of isothermy which is as good as possible and makes it possible to precisely determine the zone of the condensation of the filling by intentionally setting a temperature gradient.

Whilst completely dispensing with a coating, the region of the laminates is optically transparent or at least translucent. If possible, this should also be strived for regions with a coating. In order to come close to this aim, the solid angle at which the regions with a coating appear from the center of the lamp out are minimized as far as possible. This is because the coating absorbs radiation and therefore loses efficiency. For this reason, the coating should be applied to faces of the laminates which are inclined at an angle, since then their solid angle appears to be smaller from the center out. In particular, this applies to the narrow side of the laminates. One alternative is to apply the coating as far towards the rear of the laminate and/or the seal as possible, since this also reduces the effectively shadowed solid angle. In this way, an optimum value for the cooling can be achieved with at the same time optimum efficiency. Particularly effective coatings are graphite and TiC.

A control means for the cooling effect is also the maximum height of the laminate, in particular if it attaches to the discharge vessel, since, depending on the attachment height, the dissipation takes place from another temperature level.

A particular advantage of such integral laminates is the fact that they first cool particularly effectively in comparison with separate attachments and that they can be produced easily if modern manufacturing processes are used, such as injection-molding, slip-casting or rapid-prototyping processes.

BRIEF DESCRIPTION OF THE DRAWINGS

The invention will be explained in more detail below with reference to a plurality of exemplary embodiments. In the figures.

PREFERRED EMBODIMENT OF THE INVENTION

Figure 1:
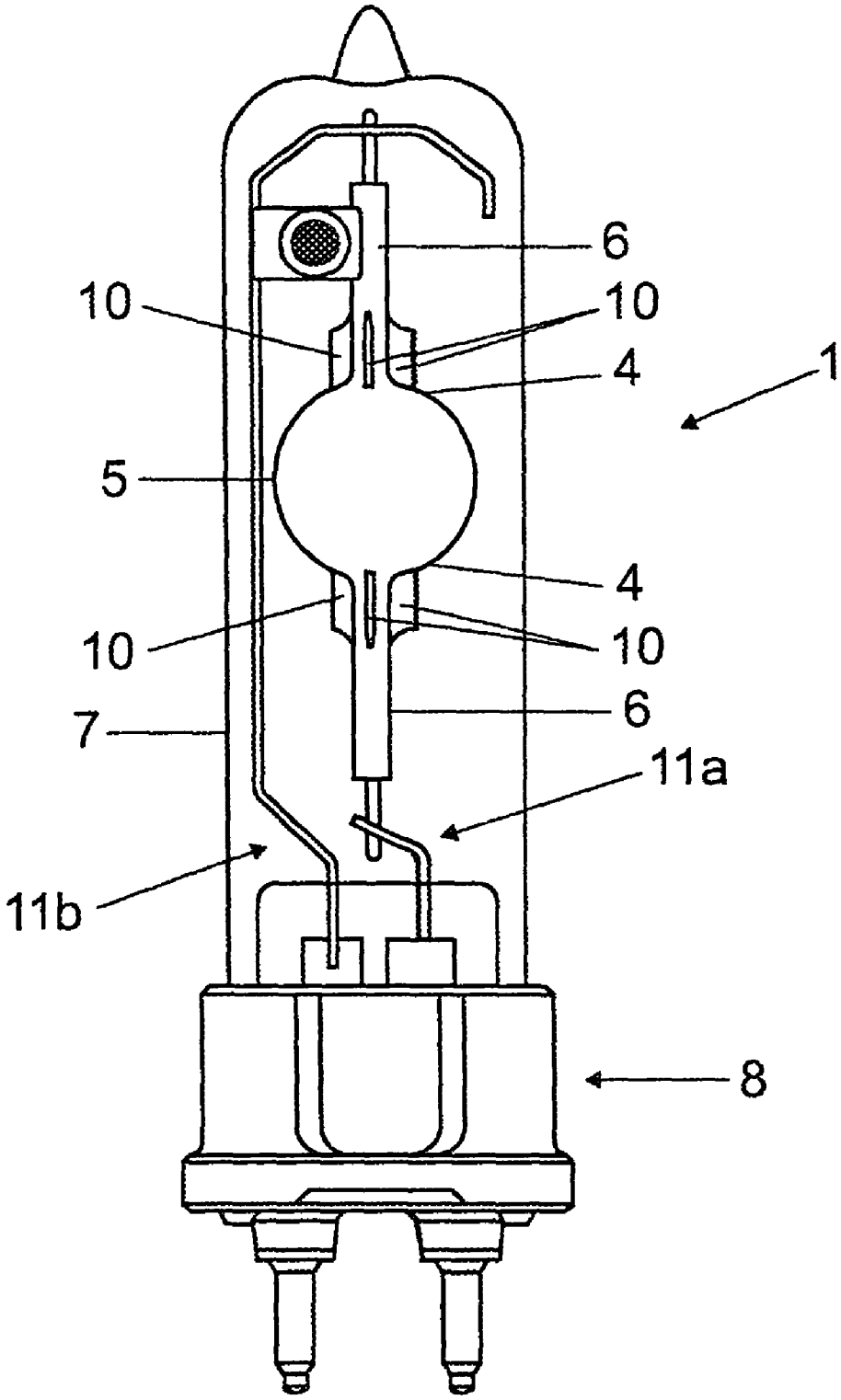
FIG. 1 shows a high-pressure discharge lamp.

FIG. 1 shows a metal-halide lamp 1. It comprises a tubular discharge vessel 2 consisting of ceramic, into which two electrodes are inserted (not shown). The discharge vessel has a central part 5 and two ends 4. Two seals 6, which are in this case in the form of capillaries, are positioned at the ends. Preferably, the discharge vessel and the seals are produced integrally from a material such as PCA.

The discharge vessel 2 is surrounded by an outer bulb 7, which is terminated by a base 8. The discharge vessel 2 is held in the outer bulb by means of a frame, which contains a short and a long power supply line 11*a* and 11*b*. In each case laminates 10, which extend radially outwards in the form of fins, are positioned on the seals 6.

Figure 2:
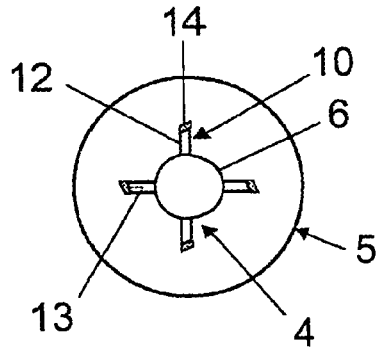
FIG. 2 shows a detail of the discharge lamp from FIG. 1.

FIG. 2 shows a plan view of the region of a seal 6. The laminates 10 have two broad sides 12 and one narrow side 13. The laminates are distributed in four-point fashion uniformly around the seal. A layer 14 with high emissivity and consisting of graphite or carbon is provided on the narrow sides 13, which are beveled. The laminates have a maximum height of approximately half the maximum height of the central part of the discharge vessel.

Figure 3:
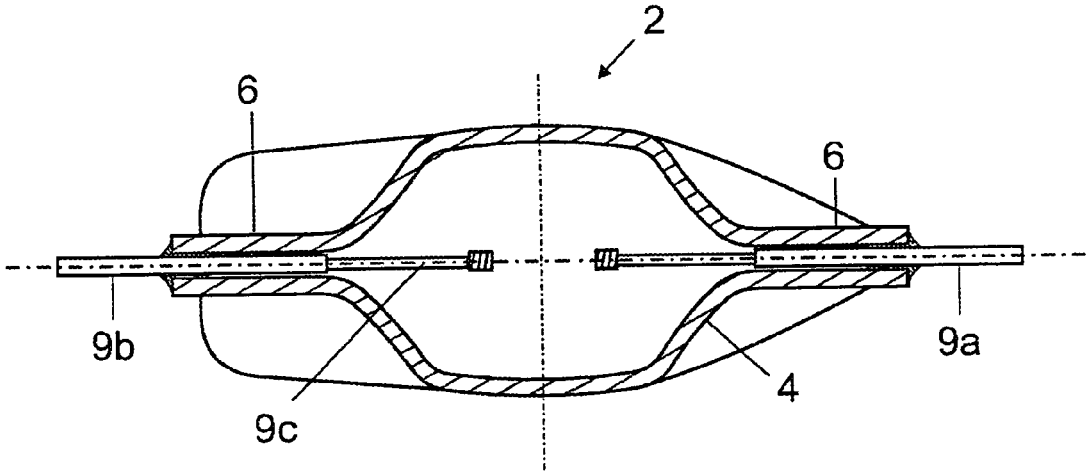
FIG. 3 shows a further exemplary embodiment of a discharge vessel.

FIG. 3 shows a discharge vessel 2, in which, in the exemplary embodiment on the left-hand side, the laminates 15 branch off from approximately the maximum height of the end of the discharge vessel and maintain the height. In the exemplary embodiment on the right-hand side, the mass of the laminate is markedly less as a result of the fact that the maximum height of the laminate uniformly decreases with increasing distance from the end 4. These two exemplary embodiments show that the form of the laminate can be matched precisely to the present requirements. The number, total mass and length of the laminates can be optimized depending on the desired degree of cooling.

Figure 4:
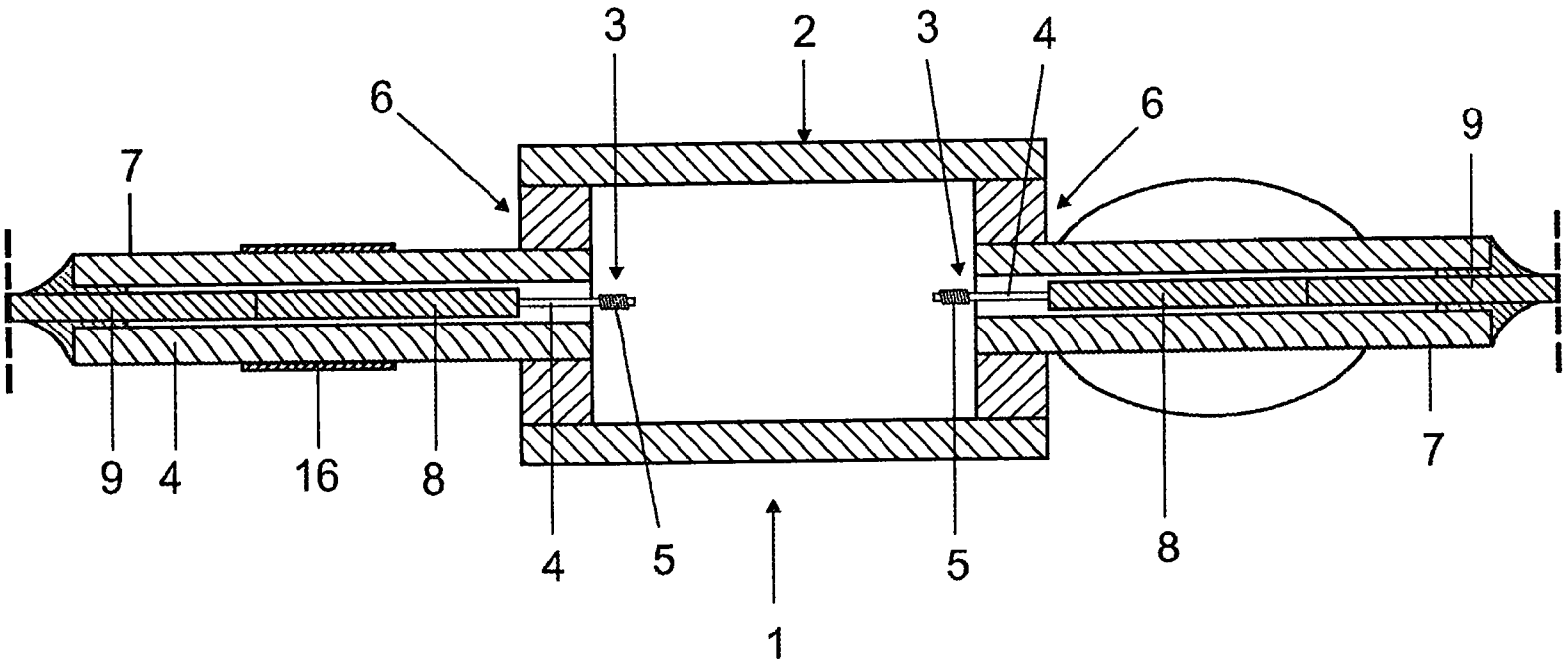
FIG. 4 shows a further exemplary embodiment of a discharge vessel.

In the left-hand exemplary embodiment, FIG. 4 shows the possibility of effecting cooling merely by means of a coating 16, which completely surrounds the seal in the manner of a collar in its central part. In the right-hand exemplary embodiment, a type of laminate 17 is shown which is only located on the seal itself and does not extend any further onto the discharge vessel, which in this case is separate from the capillary. The laminate is in this case in the form of a circular segment.

Figure 5A:
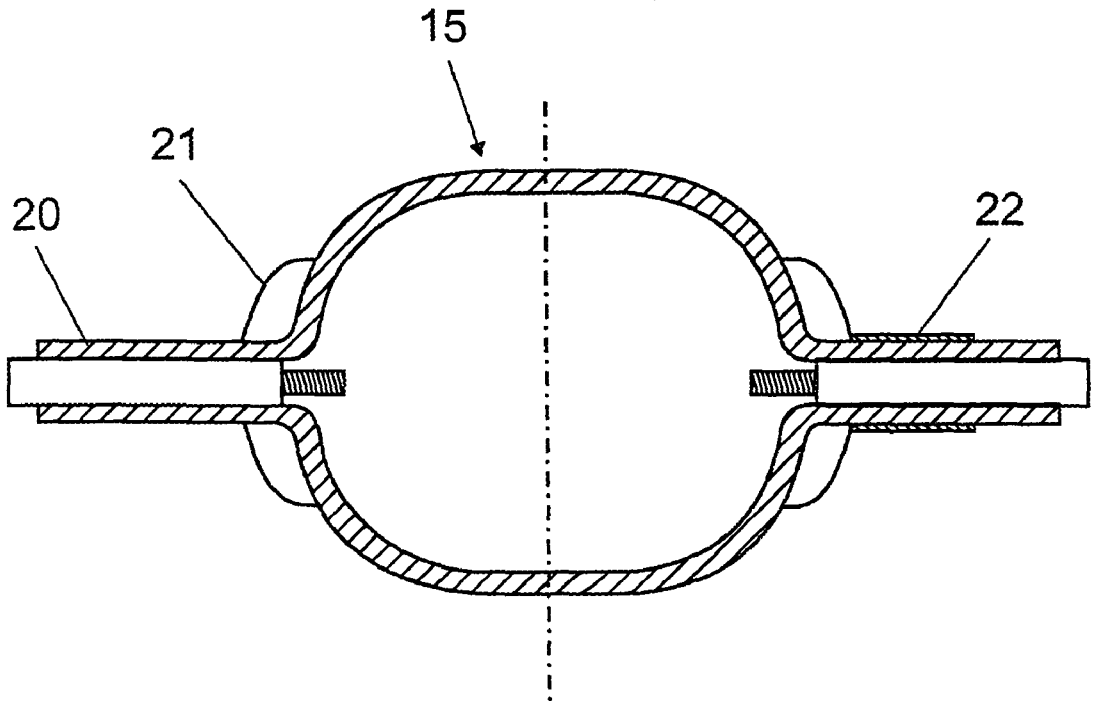
FIGS. 5 to 10 each show a further exemplary embodiment of a discharge vessel.
Figure 5B:
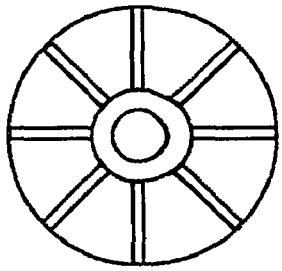

FIG. 5 shows, in the left-hand exemplary embodiment, a discharge vessel 19 with a short seal 20 and very short laminates 21, but with in total eight laminates being used. In addition, FIG. 5 shows in the right-hand exemplary embodiment an arrangement in which, in addition to these laminates, a rotationally symmetrical coating 22 after the laminates is used.

Further exemplary embodiments are those with a higher number of points than 8, primarily up to 16. In this case, the number of fins dos not need to be an even number; it may also be an odd number, for example five fins. A further exemplary embodiment is characterized by the fact that differently designed groups of laminates are used, for example two groups on a seal whose width and height is different and which alternate.

Each laminate or fin has a given maximum height, which extends radially with respect to the axis of the discharge vessel, and a maximum length, which extends axially, and a maximum width. All three variables can have a constant value, but usually vary such that they are matched optimally to the requirements.

The length L of the fin or laminate can range from a fraction of the total length GL of the discharge vessel including the length of the seals themselves, in particular from at least one twentieth, to half the total length, i.e. $\frac{1}{20}$ GL=L=0.5 GL. In the event that L=0.5 GL, the fin and its mating piece at the other end together extend effectively over the entire discharge vessel.

The height H of the fin or laminate can range from a fraction, in particular one tenth, of the difference DF between half the maximum outer diameter of the discharge vessel and half the diameter of the capillary to twice, in particular 1.4 times, particularly preferably up to one times, this difference DF, i.e. $\frac{1}{10}$ DF=H=2 DF, preferably $\frac{1}{5}$ DF=H=1.4 DF. The fins can also be stepped, i.e. their height H varies in steps along the length L.

The width B of the fin is often constant and usually fluctuates in the range from 0.2 to 1.5 mm. A second preferred embodiment is a radially outwardly decreasing width. An outwardly increasing width is also possible, with in particular the arc length BL of the width B remaining constant. A typical arc length BL is $\frac{1}{10}$ of the circumference U of the seal down to $\frac{1}{50}$ U, i.e. in this case $\frac{1}{50}$=BL/U=$\frac{1}{10}$. Another form of the width of the fin is triangular or in particular trapezoidal, when viewed in cross section.

The longer the fins are, the smaller the wall thickness of the discharge vessel or else of the capillary can be selected to be. If the fins are drawn over the entire axial length of the seal, usually a capillary, the surface of the seal is thereby markedly increased in size. If an unstructured tube as the seal is compared with a tube having the same outer diameter and provided with fins, the heat flow towards the ends is reduced by the reduced cross section.

Figure 6:
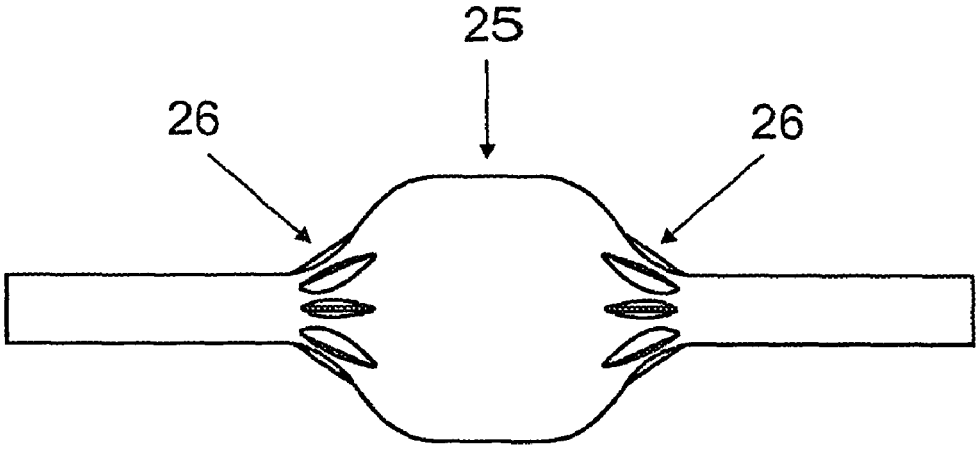

FIG. 6 shows a discharge vessel 25 with laminates 26, in which the height H changes continuously from the value of zero inwards up to a maximum of approximately H=0.5 DF.

Figure 7:
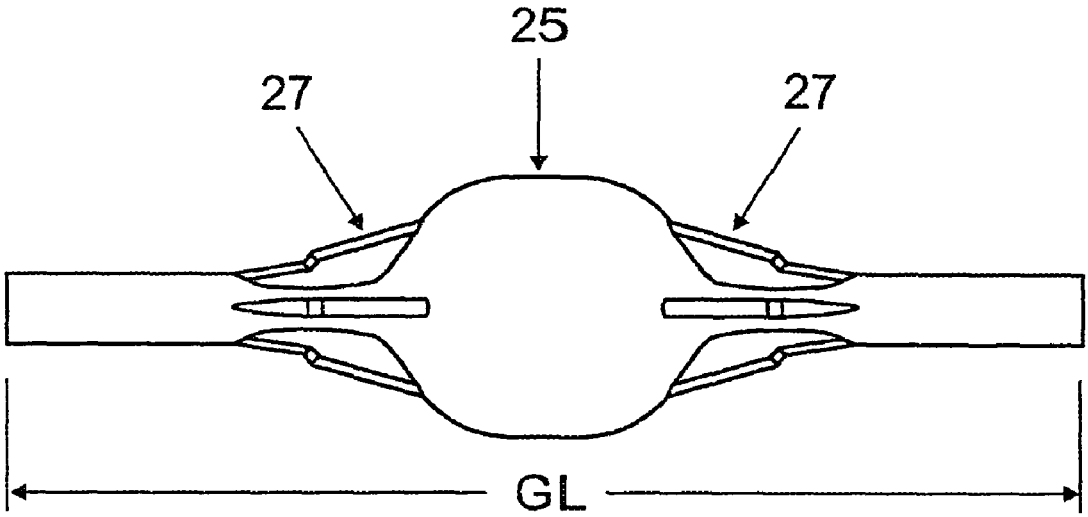

FIG. 7 shows a discharge vessel 25 with stepped laminates 27, with the result that the height H of the laminate changes suddenly. In addition, the definition of the total length GL is illustrated here.

Figure 8:
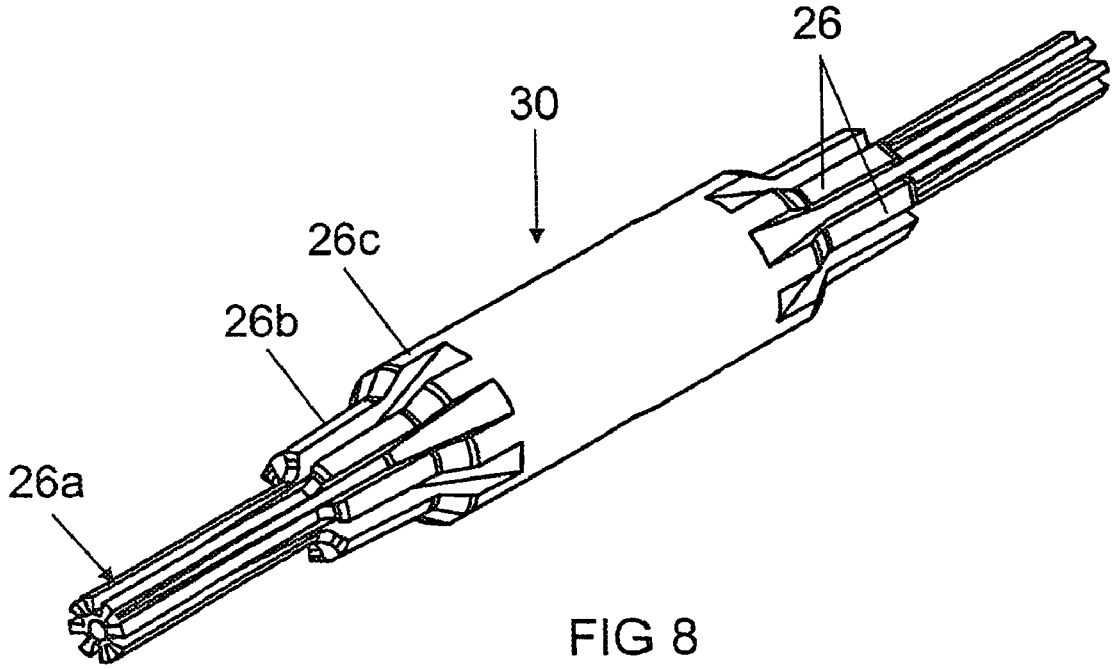

FIG. 8 shows a cylindrical discharge vessel 30 with stepped laminates 26, in which the laminates extend over the entire length of the seal. A low part 26*a* of the laminates is drawn as far as the end of the discharge vessel, with the height of the laminates further increasing in two steps. Part 26*b* has approximately 50% of the height corresponding to the diameter of the discharge vessel, and part 26*c* has 100% of the height of the diameter of the discharge vessel.

Figure 9:
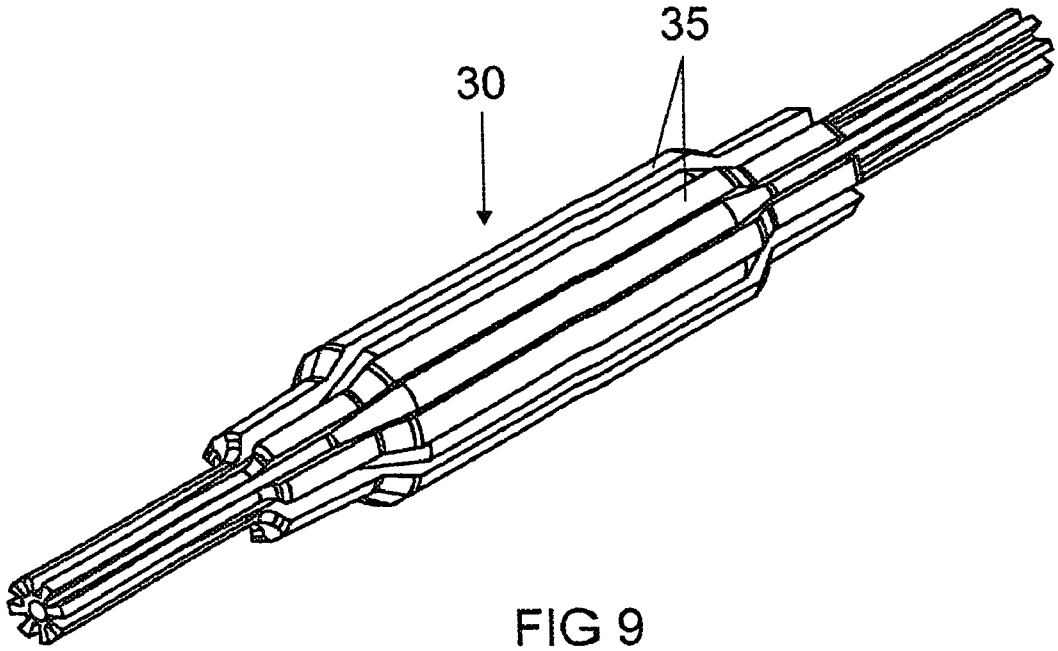

FIG. 9 shows a cylindrical discharge vessel 30, in which the entire length of the discharge vessel is covered by laminates 35.

Figure 10:
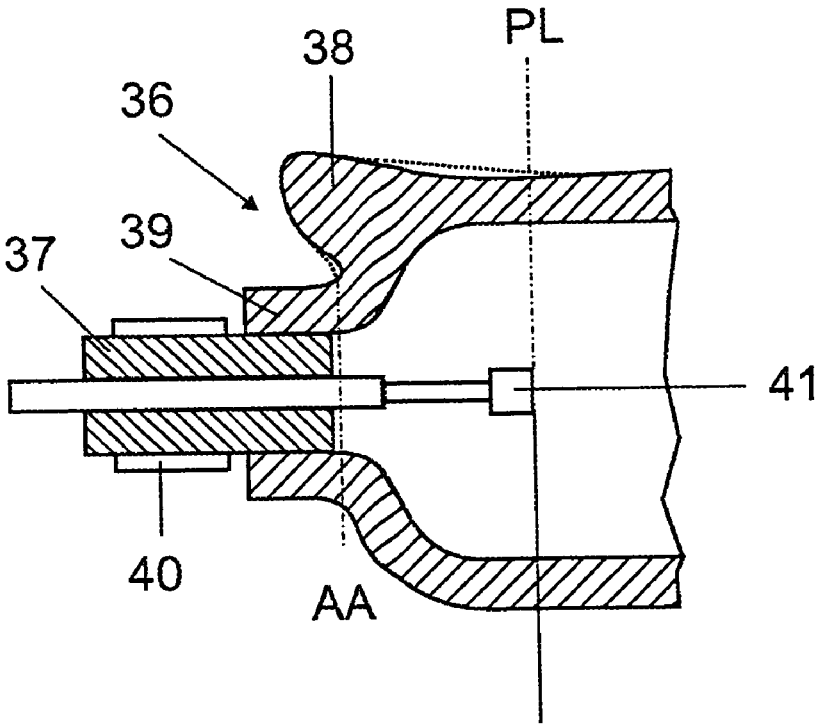

FIG. 10 shows an illustration of the end 36 of a discharge vessel which is closed by a separate stopper 37. In this case, the laminate 38 has the form of a fin, which is attached just behind the line PL and then extends approximately as far as the attachment of the end tube 39. Small laminates 40 are additionally arranged on the stopper 37.

At the same time, this figure is used to explain the term projection line PL at the tip of the electrode 41. The concept of the invention consists in the fact that fin-like laminates, as shown here by 38, are positioned at least on one end of the discharge vessel and extend radially outwards at their height H, the surface of the laminates overall predominately being arranged in a region which is positioned, remote from the discharge, behind a line which is fixed by the projection of the tip of the electrode onto the inner surface of the discharge vessel. Preferably, this amount is at least two thirds. However, it may be up to 100%. The fin can in this case only extend between the projection line PL and the attachment AA of the seal, where it has the greatest effect, or can extend further towards the rear on part or over the entire length of the seal. However, it can also attach in the region of the seal. The dashed lines indicate possible exemplary embodiments of the fin.

Figure 11:
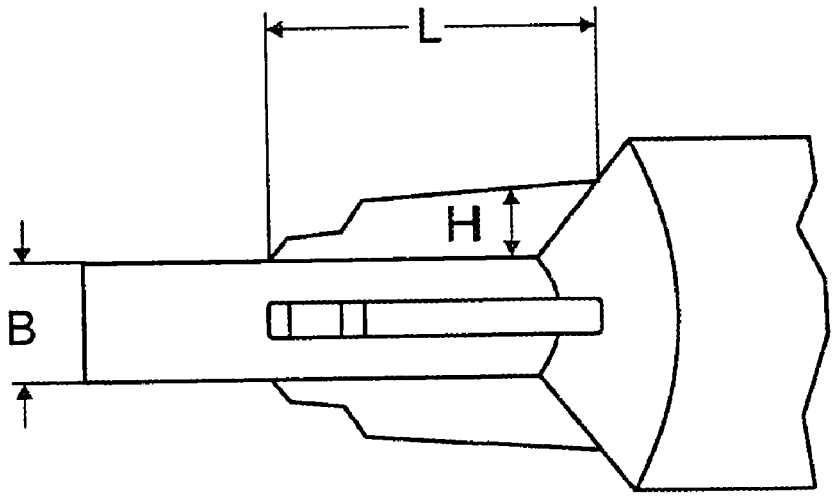
FIG. 11 shows a schematic illustration of the geometric parameters of the laminate.

FIG. 11 shows a schematic illustrating the terms for the height H, width B and length L of the laminates. In the case of variables for the dimensions H, B and L, in each case a maximum height, width and length is meant.

The invention claimed is:

1. A high-pressure discharge lamp having a ceramic discharge vessel with a central part and two ends, which are sealed by two seals, electrodes being anchored in the seals and extending into the discharge volume enveloped by the discharge vessel, a filling, which contains metals and/or metal halides, being accommodated in the discharge volume, characterized in that fin-like laminates are positioned at least on one end and extend radially outwards at their height H, the surface of the laminates overall predominantly being arranged in a region which is positioned, remote from the discharge, behind a line which is fixed by the projection of the tip of the electrode onto the inner surface of the discharge vessel, wherein the laminates and discharge vessel are integral with each other and comprise $Al_2O_3$, AlON or AlN, and wherein the laminates have two broad sides and one narrow side, the narrow side being positioned radially on the outside.

2. The high-pressure discharge lamp as claimed in claim 1, wherein the arrangement of the laminates is such that they are rotationally symmetrical to one another with a three-fold to eight-fold symmetry.

3. The high-pressure discharge lamp as claimed in claim 2, wherein the form of the laminates is substantially identical or is identical in groups.

4. The high-pressure discharge lamp as claimed in claim 1, wherein the discharge vessel has an aspect ratio of from 1.5 to 8.

5. The high-pressure discharge lamp as claimed in claim 1, wherein the wall thickness of the laminates approximately corresponds to the wall thickness of the central part of the discharge vessel and deviates from this by at most 50%.

6. The high-pressure discharge lamp as claimed in claim 1, wherein the seals are in the form of capillaries.

7. The high-pressure discharge lamp as claimed in claim 1, wherein the laminates are positioned on a part of the seals which is adjacent to the ends.

8. The high-pressure discharge lamp as claimed in claim 7, wherein the laminates attach at the ends and have the same maximum diameter as the ends.

9. The high-pressure discharge lamp as claimed in claim 1, wherein the narrow side is beveled.

10. The high-pressure discharge lamp as claimed in claim 1, wherein part of the laminate is covered with a coating having a high emissivity.

11. The high-pressure discharge lamp as claimed in claim 1, wherein at least one laminate has subareas of different heights H which are delimited by at least one edge, and at least one of these subareas is provided with a coating.

12. The high-pressure discharge lamp as claimed in claim 1, wherein at least one laminate has a maximum height H, a maximum width B and a maximum length, it being possible for each of these variables to be constant or to be variable in favour of smaller values.

13. The high-pressure discharge lamp as claimed in claim 1, wherein the discharge vessel has a bulging shape, with the result that the diameter of the discharge vessel reduces in size towards the ends.

* * * * *